US006318757B1

(12) United States Patent
Ritchie et al.

(10) Patent No.: US 6,318,757 B1
(45) Date of Patent: Nov. 20, 2001

(54) INTEGRATED DUAL-LAMINATE IDENTIFICATION CARD IN A FORM AND METHOD OF MAKING THE CARD

(75) Inventors: William Dale Ritchie, Richmond; Tony Plutino, Gatineau, both of (CA)

(73) Assignee: Crain-Drummond, Inc., Boucherville (CA)

( * ) Notice: Subject to any disclaimer, the term of this patent is extended or adjusted under 35 U.S.C. 154(b) by 0 days.

(21) Appl. No.: 09/684,130

(22) Filed: Oct. 10, 2000

(51) Int. Cl.[7] ..... B42D 15/00

(52) U.S. Cl. ..... 283/75; 283/109; 283/101; 283/105; 283/77; 283/78

(58) Field of Search ..... 283/77, 78, 75, 283/81, 101, 105; 156/152, 235, 249; 428/203

(56) References Cited

U.S. PATENT DOCUMENTS 4,330,350 * 5/1982 Andrews ..... 283/77
4,706,600 * 11/1987 Mason, Jr. et al. ..... 283/78 X
5,161,827 * 11/1992 Grosso ..... 283/77
5,330,231 * 7/1994 Godfrey ..... 283/77 X
5,358,582 * 10/1994 Koshizuka et al. ..... 156/235
5,900,307 * 5/1999 Barcikowski ..... 428/203
6,022,051 2/2000 Casagrande .

* cited by examiner

*Primary Examiner*—Willmon Fridie, Jr.
(74) *Attorney, Agent, or Firm*—Jacobson Holman, PLLC

(57) ABSTRACT

A carrier sheet has a detachable totally laminatable card integrally formed therewith. A clear plastic film patch having two thin plastic film sheets laminated together by an adhesive therebetween and a release coating, is glued to the back of the sheet in a card area. The inner one of the plastic film sheets has the release coating on its inner surface in contact with the adhesive secured to an inner surface of the outer one of the plastic film sheets. A card is delineated by a die-cut made in the front surface of the carrier sheet and extending to the adhesive between the film sheets. A perforation cut is made in the outer one of the plastic film sheets and aligned with the die-cut. A photograph or fingerprint is applied in a designated area on the outer face of the card. When the die-cut card is peeled off the front surface of the carrier sheet, it creates a card window exposing the adhesive and by positioning the outer face of the card into the card window and pressing on the card, and then pushing the card through the form, the front face of the card becomes laminated with the outer plastic film sheet. The inner surface of the card is laminated by the inner film sheet when the patch is applied and the card is die-cut. Accordingly, there is formed a personalized card which is plastic film laminated on both faces.

10 Claims, 2 Drawing Sheets

INTEGRATED DUAL-LAMINATE IDENTIFICATION CARD IN A FORM AND METHOD OF MAKING THE CARD

TECHNICAL FIELD

The present invention relates to a dual-laminate identification card integrally formed in a carrier sheet or a form and a method of making the card. More specifically, and not exclusively, the card carrier sheet is a voter registration sheet and i.d. card.

BACKGROUND ART

It is known in the prior art to form identification cards which are printed and die-cut in a paper carrier sheet bearing printed material and instructions to form the card. However, the majority of these cards are paper cards and they do not have a long-lasting life. In my related pending application Ser. No. 09/684,129, and entitled "Integrated Plasticized Card in a Paper Carrier and Method of Manufacture", I disclose one method of forming a plastic laminated card wherein a plastic film sheet is disposed on both the front and rear outer surfaces of the card. The advantages of providing such cards are disclosed in that pending application. The cards formed by the invention disclosed in that pending application and in the known prior art contain solely preprinted information on the cards and these cards have a variety of uses. U.S. Pat. No. 6,022,051 relates to a similar type from with an integrated die-cut removable card.

SUMMARY OF INVENTION

It is a feature of the present invention to provide another type of dual-laminated plastic card containable in a carrier sheet or form and wherein personal information may be written, printed or glued on a paper face of the card contained within the form, by a user person, and prior to detaching the card from the form to laminate the front face of the card by using the card window created when the card is detached, all this being done by the user person.

Another feature of the present invention is to provide a card product and method of making the form and integrated card for use in a secure person identification and recording system for voter registration.

Another feature of the present invention is to provide a card incorporated in a form to be used by an end user as an identification/record system such as for schools, transportation, employee, trade shows, etc. and wherein the card is personalized by the user before being laminated on both faces by the end user.

Another feature of the present invention is to provide a carrier sheet or form having a detachable totally laminatable card integrally formed therewith and wherein the end user or any other user person can affix a photograph or fingerprint on the card front face prior to laminating the front face by the use of the form and more specifically by a card window created by the removal of the card from the form.

Another feature of the present invention is to provide a carrier sheet having a detachable totally laminatable card integrally formed therewith and wherein the form and/or the card contain various security features on the paper part as well as the films containing a holographic image.

According to the above features, from a broad aspect, the present invention provides a carrier sheet having a detachable, totally laminatable card, integrally formed therewith. The carrier sheet has a clear plastic film patch secured to a rear surface thereof and overlying a card region on a front surface of the carrier sheet in which a card is to be formed. The clear plastic film patch comprises two thin plastic film sheets laminated together by an adhesive therebetween. An adhesive release agent is coated on an inner surface of an inner one of the plastic film sheets and in contact with the adhesive. A further adhesive secures the inner one of the plastic film sheets in contact with the rear surface of the carrier sheet, plastic Card information is printed on at least the card region on the front surface of the carrier sheet. The card is delineated by a die-cut extending from the front surface of the carrier sheet to the adhesive between the laminated film sheets. A perforation cut is formed in the outer one of the two thin plastic film sheets and adhesive between the film sheets and aligned with the die-cut. The die-cut card when peeled off the front surface of the carrier sheet releases the card cut portion of the inner one of the two thin plastic film sheets from the adhesive between the laminated film sheets with the card now laminated on a back face thereof by the adhesive and inner film sheet and exposing a card window across which extends the adhesive between the film sheets whereby to permit a front face of the card to be positioned top face down and pressed in the window to cause the adhesive to stick to the front face of the card to secure the outer film sheet thereto. The card is then pushed through the form to break the perforation with the outer film secured to the front face of the card to produce a card which is plastic film laminated on both faces. The information printed on the card region is in the form to receive additional personal information including a delineated area to secure a photograph and/or fingerprint.

According to a further broad aspect of the present invention there is provided a method of making a dual-laminated card from a carrier sheet. The method comprises the steps of providing a carrier sheet having a card printed and die-cut on a front surface of the carrier sheet. The carrier sheet has a clear plastic film patch secured to a rear surface thereof and overlying the die-cut card. The patch comprises two thin plastic film sheets laminated together by an adhesive therebetween. An adhesive release agent is coated on an inner surface of an inner one of the plastic film sheet and in contact with the adhesive. A further adhesive secures an inner one of the plastic film sheets in contact with the rear surface of the carrier sheet. The die-cut extends to the adhesive between the laminated film sheets. The outer one of the plastic film sheets and the adhesive between the laminated film sheets is perforated along the die-cut. The die-cut card is peeled off from the front surface of the carrier sheet to expose a card window in the carrier sheet across which extends the outer film sheet and adhesive. The card that has been peeled off is then positioned in the card window with a front face of the card against the adhesive and the card is then pressed through the carrier sheet to cause the adhesive and the outer plastic film to stick to the front face. By pushing the card through the carrier sheet the perforation of the outer plastic film is broken and the outer plastic film is stuck to the front face of the card thereby producing a card which is plastic film laminated on both faces.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
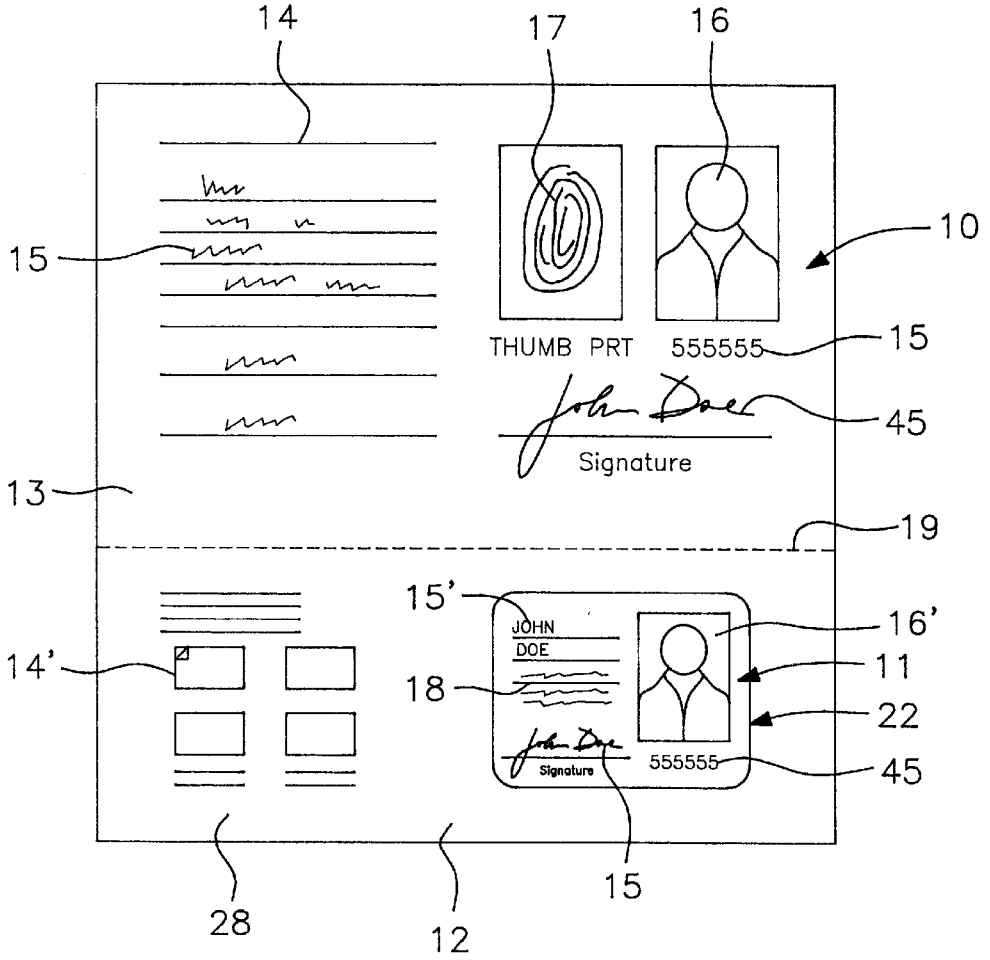
FIG. 1 is a front view of a carrier sheet or form having a detachable totally laminatable card integrally formed therewith in accordance with the present invention.
Figure 2:
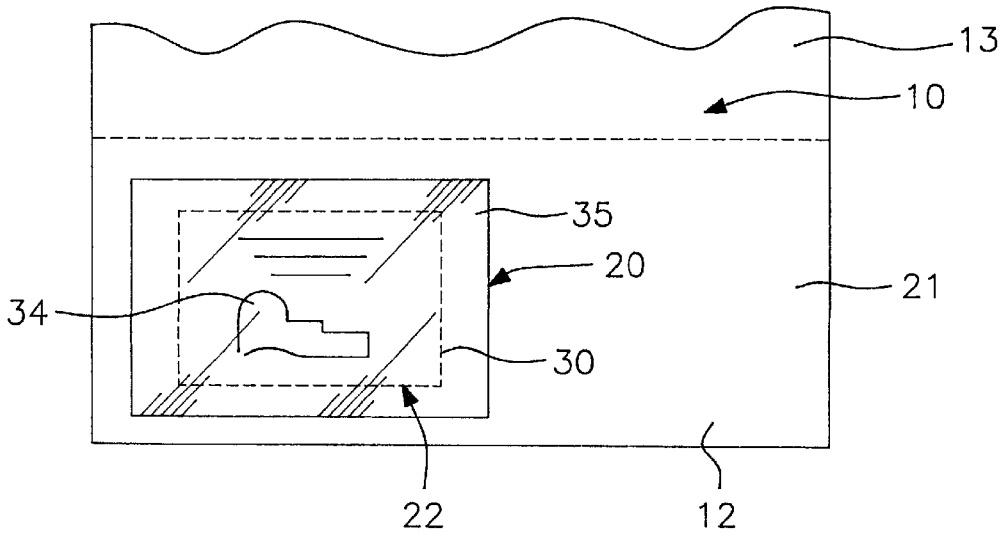
FIG. 2 is a front view, partly fragmented, showing the rear surface of the carrier sheet in the lower region thereof containing the card to be formed.

Referring now to the drawings and more particularly to FIGS. 1 and 2, there is shown a carrier sheet 10, formed of paper or synthetic material, having a detachable and totally laminatable identification card 11 integrally formed therewith. As hereinshown the card 11 is formed in a detachable lower portion 12 of the carrier sheet 10. The upper portion 13 of the form is hereinshown as constituting a secure identification and recording sheet for a voter registration system. In the upper portion there is provided printed material 14 wherein to incorporate personal data 15 of a person whose identity is revealed by a photograph 16 or a thumb print 17.

In the detachable lower form there is also provided printed information 14' and printed card information 18 in which personal data 15' is printed or written. The personal data 15 and 15' also includes a signature of the person made by the user person.

If the embodiment of form, as illustrated in FIG. 1, is utilized in a voter registration data keeping system, a photo 16' or a finger print (not shown) may be affixed at the time that the form is filled and the form user can then laminate the card 11 in the presence of a person during the completion of the form and in accordance with the method as will be described later. Alternatively, for a multitude of other uses such as school identification cards, transportation identification cards or employee identification cards, or trade show registration identification cards, etc., the detachable lower portion 12 can be detached along the straight perforation line 19 and mailed to the intended person who would then affix his own photograph to the front face of the card and produce the dual laminated card. How the dual laminated card is produced will now be described.

As shown in FIG. 2, a clear plastic film patch 20 is secured to a rear surface 21 of the detachable lower portion 12 and overlying a card region 22. Of course, depending on the intended use of the form, this card region could be located anywhere or there may be two or more cards formed in the same carrier sheet. It is to be understood that the carrier sheet with the card may be a single sheet with no detachable portions.

Figure 3:
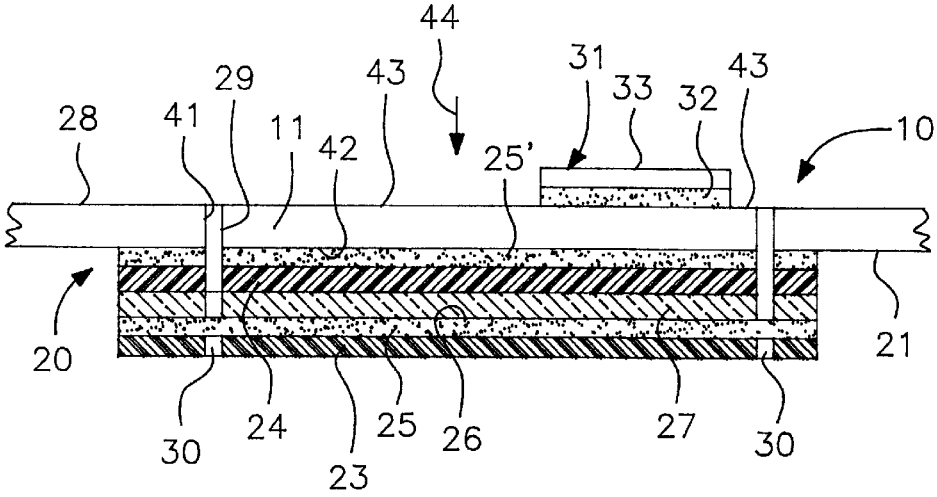
FIG. 3 is a section view, in exaggerated form, to illustrate the construction of the detachable and laminatable card integrally formed with the carrier sheet and wherein an adhesive patch is optionally secured to the front surface of the card whereby to affix a photograph thereon.

With further reference now to FIG. 3, it can be seen that the clear plastic film patch 20 comprises two thin plastic film sheets, namely an outer plastic film sheet 23 and an inner plastic film sheet 24 laminated together by an adhesive 25. An adhesive release agent coating 26, such as a silicone coating, is applied on an inner face 27 of the inner plastic film sheet 24. The patch 20 is formed of poly plastic film material and an adhesive 25' is utilized to bond the patch 20 to the rear surface 21 of the carrier sheet.

The card 11 is delineated on the front surface 28 of the paper sheet by a die-cut 29 which extends from the front surface 28 of the carrier sheet 10 to the adhesive 25. A perforation cut 30 is made in the outer plastic film sheet 23 and adhesive 25 and aligned with the die-cut, as shown in FIG. 2. The double laminated poly patch is applied through known manufacturing equipment and the die-cut and perforation cut is also made by known manufacturing equipment using a double height die and perforation combination cylinder.

If the detachable lower portion of the form is sent to an end user without a photograph affixed thereto, then a delineated area is provided to identify where a photograph has to be secured. Alternatively, a silicone liner covered adhesive patch 31 containing an adhesive 32 secured to the photo area and a silicone release cover paper 33 may be applied to the front surface 28 of the carrier sheet 10 whereby removal of the silicone liner would expose the adhesive 32 to permit ease of securement of the photograph 16 thereon. It is also pointed out that the rear surface 21 of the form may have printed material and graphics 34 printed thereon in the card region 22 so that the card has printed material on both sides. Also, holographic images 35 may be contained in one or both of the plastic film sheets 23 and 24, to prevent forgeries. These plastic film sheets are also of a specification capable of withstanding a predetermined range of temperatures for processing in heat generating equipment, i.e., laser printers.

Figure 4:
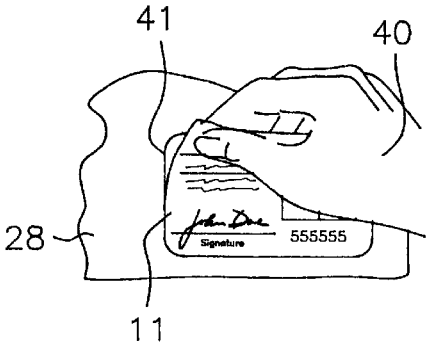
FIG. 4 is a perspective view showing the card being detached from the form.
Figure 5:
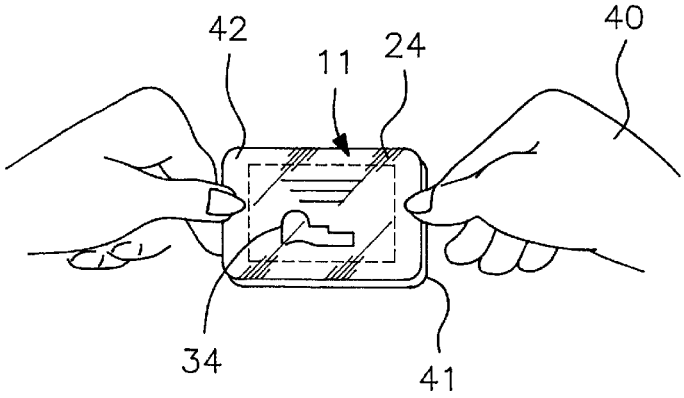
FIG. 5 is a perspective view showing the card being repositioned in a card window but the with the front face of the card facing the window.
Figure 6:
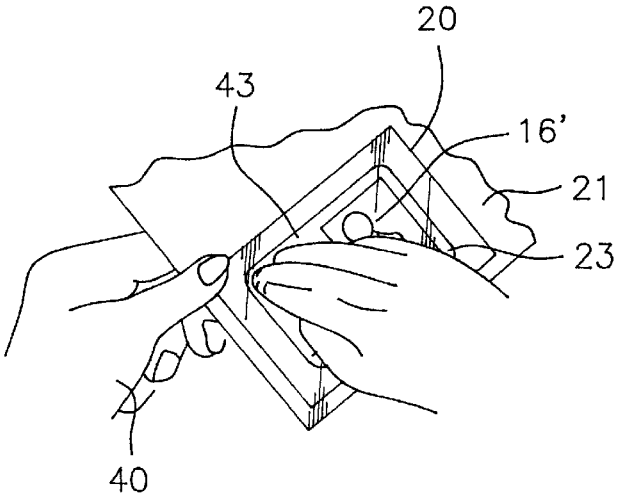
FIG. 6 is a perspective view showing the card being pushed through the form with the front face laminated.
Figure 7:
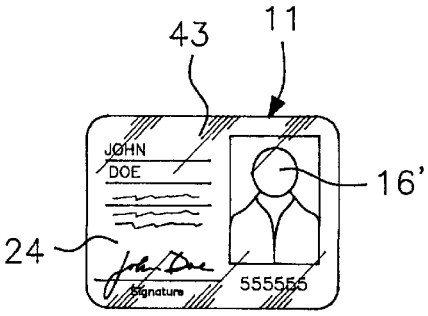
FIG. 7 is a front view showing the front face of the card laminated with the outer plastic film sheet attached to the rear surface of the carrier sheet or form.

With reference now to FIGS. 4 to 7, there will be shown the manner in which the card is laminated by a user person. If it is required to add personal data onto the card as well as a photograph or fingerprint, this is done by the user person or by an attendant at the time of registration, in accordance with instructions, such as the printed information 14' provided on the form adjacent the card. As shown in FIG. 4, the user person 40 peels the die-cut card 11 from the front surface 28 of the form, thereby exposing a card window 41 which is the same size as the card 11. When the card is removed from the window 41, the inner plastic film sheet 24 is adhesively secured to the rear surface 42 of the card 11 due to the die-cut 29 extending through the adhesive 25'. Accordingly, the rear surface 42 of the card is now laminated, as shown in FIG. 5. The adhesive 25 is now exposed in the card window 41 as well as the outer plastic film sheet 23 carrying the adhesive. By inverting the card with the front face 43 facing the window 41, as shown in FIG. 5, and positioning it in the window and pressing the card with the form disposed on a support surface, the front face 43 of the card is permanently stuck to the adhesive 25 and accordingly stuck to the outer film sheet 23. The card is then pushed through the carrier sheet against the outer film sheet 23, in the direction of arrow 44, as shown in FIG. 3, that is to say from the form front surface 28 to the rear surface 21, wherein the perforation lines 30 will break thus releasing the die-cut portion of the outer plastic film sheet 23 which is now laminated to the front surface 43 of the card. If a picture was present on the front surface it is now laminated. There is thus formed a double surface laminated identification card in accordance with the present invention.

As previously described, various security features may be incorporated in the carrier sheet as well as in the plastic film sheets. Also, as shown in the voter registration form of FIG. 1, an identification number 45 may also be printed on the upper portion 13 of the form as well as in the card region 12 and preferably under the photo area.

Briefly summarizing the method of making a dual-laminated card from a carrier sheet, there is provided the following steps. Firstly, a carrier sheet having a card printed on a front surface of the carrier sheet is provided. The carrier sheet has a clear plastic film patch secured to a rear surface thereof, as above-described, and overlying a pre-printed card which is formed on the front surface of the carrier sheet. The patch comprises two thin plastic film sheets 23 and 24 which are laminated together by an adhesive 25 therebetween and a release coating 25. The inner one of the plastic film sheets has an adhesive 25' in contact with the inner surface of the carrier sheet 11. The die-cut 29 extends to the adhesive 25 and accordingly severs the inner plastic film sheet 24 along the die-cut. The outer plastic film sheet 23 is perforated in line with the die-cut. To produce the card, the integral card is simply peeled off the front surface 28 of the form to expose a card window 41 exposing the adhesive 2 and it is then inverted and press-fitted into the window to secure its outer face 43 to the adhesive and then pushed through the form whereby to detach the outer plastic film sheet 23 along its perforation and thereby laminating the front surface 43 of the card 11 therewith. A photograph 16 or fingerprint is simply glued or printed onto the printed card while it is still in the form and personal information can be inscribed thereon prior to laminating the front face.

It is within the ambit of the present invention to cover any obvious modifications of the preferred embodiment described herein, provided such modifications fall within the scope of the appended claims.

We claim:

1. A card carrier sheet having a detachable totally laminatable card integrally formed therewith, said carrier sheet having a clear plastic film patch adhesively secured to a rear surface thereof and overlying a card region on a front surface of said carrier sheet in which a personalized card is to be formed, said clear plastic film patch comprising two thin plastic film sheets laminated together by an adhesive therebetween, an inner one of said plastic film sheets having an adhesive release agent on an inner surface in contact with said adhesive secured to an inner surface of an outer one of said plastic film sheets, card information printed on at least said card region on said front surface of said carrier sheet, said card being delineated by a die-cut extending from said front surface of said carrier sheet to said adhesive between said plastic film sheets, said information printed in said card region is in a form to receive additional personal information including a delineated area to secure a photograph and/or fingerprint, a perforation cut in said outer one of said two thin plastic film sheets aligned with said die-cut, said die-cut card when peeled off said front surface of said carrier sheet releasing a card cut portion of said inner one of said two thin plastic film sheets from said adhesive with said card now laminated on a back face thereof by said inner film sheet and exposing a card window across which extends said adhesive on said outer film sheet whereby to permit a front face of said card to be positioned and pressed in said window to cause said adhesive and its outer film sheet to stick to said front face of said card, said card being pushed through said carrier sheet to break said perforation and secure said perforated outer film to said front face of said card to produce a card which is plastic film laminated on both faces, and a silicone liner covered adhesive patch for attaching a photograph to said photo delineated printed area.

2. A card carrier sheet having a detachable totally laminatable card integrally formed therewith as claimed in claim 1 wherein said card carrier sheet is a voter registration card carrier sheet.

3. A card carrier sheet having a detachable totally laminatable card integrally formed therewith as claimed in claim 2 wherein said carrier sheet is a two part form with said parts detachable from one another on a perforated straight line, a first part of said form containing personal identification information of a person including a photograph and an identification number as well as the signature of such person, a second part of said form including said card region and said identification number as well as instructional printed information outside said card region.

4. A card carrier sheet having a detachable totally laminatable card integrally formed therewith as claimed in claim 3 wherein information and graphics are further printed on said rear surface of said second part of said two part form over said card region.

5. A card carrier sheet having a detachable totally laminatable card integrally formed therewith as claimed in claim 3 wherein said two part form is an identification and durable recording system for voter registration.

6. A card carrier sheet having a detachable totally laminatable card integrally formed therewith as claimed in claim 1 wherein said two thin plastic film sheets are polyester film sheets, said inner one of said plastic film sheets having a silicone coating on an outer surface thereof in contact with said adhesive.

7. A card carrier sheet having a detachable totally laminatable card integrally formed therewith as claimed in claim 1 wherein a holographic image is contained in one or both of said plastic film sheets.

8. A method of making a dual-laminated personalized card from a carrier sheet comprising the steps of:

i) providing a carrier sheet having a card printed and die-cut on a front surface of said carrier sheet, said carrier sheet having a clear plastic film patch adhesively secured to a rear surface thereof and overlying said die-cut card, said patch comprising two thin plastic film sheets laminated together by an adhesive therebetween, an inner one of said plastic film sheets having an adhesive release surface or a rear surface thereof in contact with said adhesive secured to an inner surface of an outer one of said plastic film sheets, said die-cut extending to said adhesive between said film sheets to die-cut said inner one of said plastic film sheets to produce a laminate on a rear face of said die-cut card, said outer one of said plastic film sheets being perforated along said die-cut, said card printed and die-cut further having printed information to receive additional personal information thereon, and a delineated area to receive a photograph or fingerprint, ii) affixing a photograph or fingerprint in said delineated area, iii) peeling said die-cut card from said front surface of said carrier sheet to expose a card window in said carrier sheet across which extends said adhesive and said outer film sheet, iv) positioning said card in said card window with a front face of said card against said adhesive and pressing said card to cause said adhesive to stick to said front face, and v) pushing said card through said carrier sheet to break said perforated outer plastic film which is now stuck to said front face of said card thereby producing a card which is plastic film laminated on both faces; and vi) providing a silicone liner covered adhesive patch whereby a photograph can be attached to said delineated area by said patch adhesively secured to said delineated area and the removal of said liner to expose an adhesive to secure a photograph to said patch over said delineated area.

9. A method as claimed in claim 8 wherein said carrier sheet is a two-part form person-identification form, said parts being detachable from one another, there being further provided before step (i) the steps of printing personal information of a person in a first part of said form, affixing a photograph of said person in said first part which contains an identification number of said person, said carrier sheet having said card printed and die-cut thereon being said second part of said two-part form and wherein said identification number is also contained on said die-cut card.

10. A method as claimed in claim 9 wherein there is further provided the steps of applying security material or security printing to said form and/or plastic film sheets to prevent forgeries.

* * * * *